US006389776B1

(12) United States Patent
Bremont et al.

(10) Patent No.: US 6,389,776 B1
(45) Date of Patent: May 21, 2002

(54) GAS PERMEABLE REFRACTORY BRICK FOR USE IN REGENERATIVE HEAT EXCHANGER AND HOT GRID FORMED THEREFROM

(75) Inventors: Marc Bremont; Karin Tynelius-Diez, both of Jouy en Josas Cedex; Nicolas Perrin, Champigny sur Marne Cedex; Philippe Queille, Paris; Joël Pierre; Michel Poteau, both of Champigny sur Marne Cedex, all of (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/525,117

(22) Filed: Mar. 14, 2000

(51) Int. Cl.[7] ..... F27D 1/04

(52) U.S. Cl. ..... 52/606; 52/607; 52/608; 52/609; 52/506.02; 165/9.1

(58) Field of Search ..... 52/506.02, 607, 52/608, 606, 609; 432/30, 217; 165/9.1, 9.2, 9.4, 10; 110/338

(56) References Cited

U.S. PATENT DOCUMENTS

| | | | | | |
|---|---|---|---|---|---|
| 317,459 | A | * | 5/1885 | Huston | 52/606 |
| 1,964,830 | A | * | 7/1934 | Pohl et al. | 165/9.2 |
| 2,272,108 | A | | 2/1942 | Bradley | |
| 2,493,458 | A | * | 1/1950 | Koenig | 165/9.4 |
| 2,692,131 | A | * | 10/1954 | Hasche | 165/9.1 |
| 2,706,109 | A | * | 4/1955 | Ödman | 165/9.1 |
| 3,549,136 | A | * | 12/1970 | Baab et al. | 165/9.4 |
| 4,150,717 | A | * | 4/1979 | Balke et al. | 165/9.1 |
| 4,697,531 | A | * | 10/1987 | Benedick | 110/338 X |
| 5,547,016 | A | | 8/1996 | Fassbinder | |
| 5,577,553 | A | | 11/1996 | Fassbinder | |
| 5,690,164 | A | | 11/1997 | Fassbinder | |
| 5,704,781 | A | * | 1/1998 | Swoboda | 52/606 X |
| 5,924,477 | A | * | 7/1999 | Doru | 165/9.2 |

FOREIGN PATENT DOCUMENTS

| | | | | |
|---|---|---|---|---|
| CH | 293971 | * | 1/1954 | 165/9.2 |
| DE | 711997 | * | 9/1941 | 165/9.1 |
| DE | 3424159 | * | 1/1986 | 165/10 |
| DE | 41 08 744 | | 8/1992 | |
| DE | 195 47 978 | | 7/1997 | |
| DE | 195 21 673 | | 7/1998 | |
| FR | 621629 | * | 5/1927 | 165/9.1 |

* cited by examiner

*Primary Examiner*—Laura A. Callo
(74) *Attorney, Agent, or Firm*—Burns, Doane, Swecker & Mathis, L.L.P.

(57) ABSTRACT

Provided are novel gas permeable bricks of a refractory material suitable for use in a hot grid of a regenerative heat exchanger. In accordance with one aspect of the invention, the brick has an inner face and an outer face on opposite sides of the brick. One or more cavities extend from the inner face partially into the brick. A plurality of channels for each of the cavities extend from the outer face to the cavities. The cavities and channels allow a gas to pass through the brick. Also provided is a hot grid suitable for use in a regenerative heat exchanger formed from a plurality of the bricks.

18 Claims, 5 Drawing Sheets

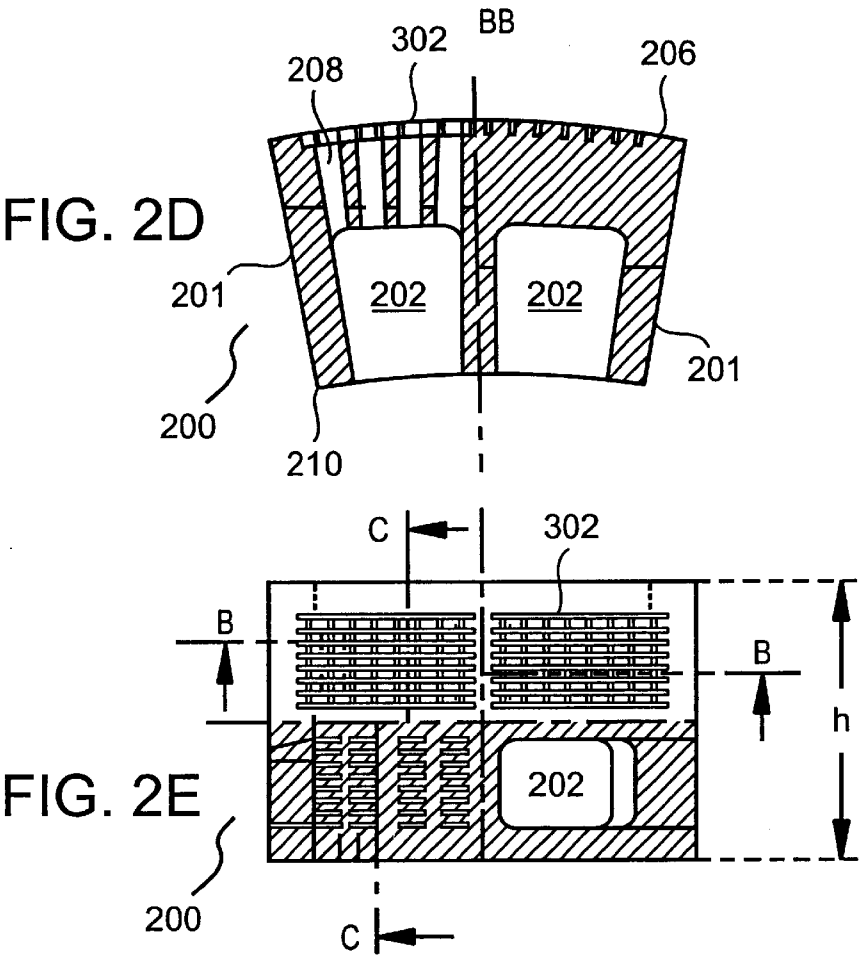
FIG. 2D
FIG. 2E
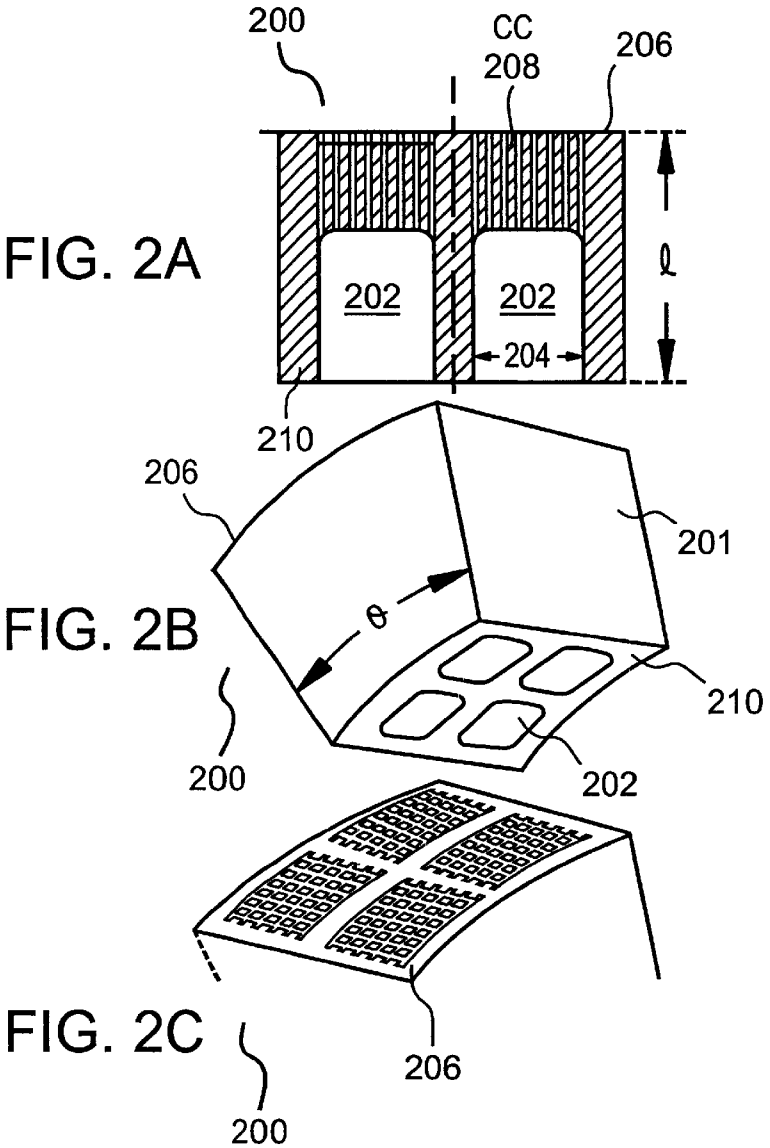
FIG. 2A
FIG. 2B
FIG. 2C

GAS PERMEABLE REFRACTORY BRICK FOR USE IN REGENERATIVE HEAT EXCHANGER AND HOT GRID FORMED THEREFROM

BACKGROUND OF THE INVENTION

1. Field of the Invention

The invention relates generally to regenerative heat exchangers, and in particular, to a gas permeable refractory brick for use therein. The invention also relates to a hot grid formed from the refractory brick.

2. Description of the Related Art

Regenerative heat exchangers operate by passing a stream of a relatively hot gas through a heat exchange mass during one period (gas phase) to store heat in the mass. A stream of a relatively cool gas is subsequently passed in the reverse direction through the mass during a second period (blast phase) to recapture this stored heat. With heat exchangers of this type, it is customary to have the gas phase and the blast phase alternately recur, and to provide at least two heat exchange masses. In this way, while heat is being stored in one of the masses, heat can be recovered from the other mass. The refractory brick lined hot stove used in the iron making industry to feed blast furnaces with hot blast is one such example of a regenerative heat exchanger.

The so called "pebble bed regenerative heat exchangers" are typically cylindrical in structure, and include a heat accumulation mass which consists of a loose bulk material arranged in a space and held in place between two concentric walls (i.e., an inner hot grid and an outer cold grid) which are permeable to gases. A hot collection chamber is circumscribed by the inner hot grid for collecting the hot gases. A cold collection chamber for collecting the cooled gases is typically defined by the space between the outer cold grid and the external wall of the regenerator.

A regenerator of the above-described type is disclosed in U.S. Pat. No. 2,272,108, to Bradley. The quantitative embodiment described in that document, however, cannot operate in practice. The gas speed selected for passing through the heat accumulation mass is much too small while the size of the particles making up the loose bulk material of the heat accumulation mass is too large. This results in an inadequately small head loss of the gas in the material bed. The pressure of the gas thus decreases with height in the cold collection chamber. This effect, known as the "stack effect", is negligible in the hot collection chamber. The pressure difference caused by the stack effect is a multiple of the pressure drop in the material bed. Consequently, when heating the regenerator, the heating gases flow only in the upper region through the material bed. Backflow of the gases might even be expected in the lower region. When working under hot blast, i.e., during cold blowing, the conditions are reversed. That is to say that only the lower region of the material bed would be exposed to the gases. These results lead to the conclusion that the regenerator described in this document would necessarily fail.

A further problem associated with the heat exchanger design of conventional hot grid structures is their tendency to accumulate dust, thereby inhibiting flow of the gas therethrough during the blast and gas phases. This results in an increase in pressure drop through the brick and heat accumulation bed.

The main concern regarding dust loading of the gas stream is plugging of the openings of the bricks in the grid, as well as sticking of the particles in the heat accumulation bed. It has been found that particles in direct proximity to the hot grid openings tend to become coated by a hard, sintered layer of dust. This dust layer acts as a cement, binding the particles together in the regions close to the hot grid openings. As a result, the porosity of the heat accumulation bed becomes decreased, and the pressure drop through the bed increases. This phenomenon is particularly detrimental to the heat transfer efficiency of the heat exchanger.

Moreover, the high operating temperatures and thermal cycles experienced by the hot grid place extreme demands on that structure. In this respect, the succession of blast phase and gas phase cycles submits the hot grid to repeated stress cycles. The mechanical stress under which the bricks and hot grid can operate is generally limited by its weak point. Such a weak point typically occurs each time an important structural change in the brick occurs. The junction between the structures is often a potential crack development location.

U.S. Pat. No. 5,577,553, to Fassbinder discloses a hot grid made up of individual bricks composed of a heat resistant material, such as ceramic. The bricks have a cavity which opens into an annular chamber containing the heat-storage medium. The cavity is filled with pellets which are mutually consolidated and secured against dropping out of the brick by a heat resistant adhesive. A blind-hole bore, starting from the wall of the brick adjacent to the hot collecting chamber enclosed by the hot grid, extends into the cavity filled with the pellets. The disclosed brick, however, is disadvantageous in that its structure is complicated and is made of numerous pieces. The brick is thus more subject to stress build up and breakage is possible, especially at the junction between pellets and between pellets and brick. The adhesive material which glues the pellets together must withstand high stresses. Moreover, the production of such a brick is not easy and induces high costs.

To avoid or conspicuously ameliorate the problems associated with the state of the art, it is an object of the present invention to provide gas permeable bricks of a refractory material suitable for use in a hot grid of a regenerative heat exchanger.

It is a further aspect of the invention to provide hot grids suitable for use in a regenerative heat exchanger formed from a plurality of the inventive bricks.

The bricks and grids in accordance with the invention allow the gases during the gas and blast phases to flow freely therethrough, resulting in a significantly lower pressure drop through the heat accumulation mass than has been possible to date. The inventive bricks and grids allow for improved distribution of the hot gas in the heat accumulation bed next to the hot grid such that flow rate and other characteristics of the gas depend only on the radius of the point at which it is measured in the bed, and not on the height of the bed or the angle of flow. At the same time, the bricks and grids in accordance with the invention provide mechanical support to the loose bulk material of the bed, are more resistant to heating and are less costly to manufacture than known bricks.

SUMMARY OF THE INVENTION

Provided are novel gas permeable bricks of a refractory material suitable for use in a hot grid of a regenerative heat exchanger. In accordance with a first aspect of the invention, the brick has an inner face and an outer face on opposite sides of the brick. One or more cavities extend from the inner face partially into the brick. A plurality of channels for each of the cavities extend from the outer face to the cavities. The cavities and channels allow a gas to pass through the brick.

The brick preferably has a shape which is a sector of a circle, the inner face facing the center of the circle and the outer face forming the periphery of the circle. The cavities are preferably symmetrically distributed over the inner face of the brick, and extend into the brick from the inner face about one half to two thirds the length of the brick, measured from the inner face to the outer face. The brick typically has a ratio of open area:closed area at the inner face of from 0.1:1 to 0.5:1, and a ratio of open area:closed area at the outer face of from 0.1:1 to 0.5:1. The brick can additionally include a plurality of grooves in the outer face overlapping the channels. The grooves typically extend from 2 to 15 millimeters into the outer face. The brick is preferably constructed from a single material and from a single piece of the material.

In accordance with a further aspect of the invention, a gas permeable brick of a refractory material suitable for use in a hot grid of a regenerative heat exchanger is provided. The brick has an inner face and an outer face on opposite sides of the brick. A plurality of channels extend through the brick from the inner face to the outer face. The channels allow a gas to pass through the brick.

The brick typically has a shape which is a sector of a circle, the inner face facing the center of the circle and the outer face forming the periphery of the circle. Preferably, the ratio of open area:closed area at the inner face and the outer face is from 0.1:1 to 0.5:1. The channels typically have a cross-sectional area of from about 4 to 500 $cm^2$, and the cross-sectional area can be substantially constant along the length thereof. A top face and a bottom face of the brick each can have at least one horizontal section and at least one non-horizontal section having a non-zero slope with respect to the horizontal section in a direction from the outer face to the inner face. The slope of the non-horizontal section is typically greater than 15° from horizontal. Preferably, the brick is constructed from a single material and from a single piece of the material.

In accordance with further aspects of the invention, hot grids suitable for use in a regenerative heat exchanger formed from a plurality of the bricks are provided.

BRIEF DESCRIPTION OF THE DRAWINGS

The objects and advantages of the invention will become apparent from the following detailed description of the preferred embodiments thereof in connection with the accompanying drawings, in which like numerals designate like elements, and in which:

FIGS. 2A–E illustrate various views of a first exemplary brick design in accordance with the invention;

DETAILED DESCRIPTION OF THE PREFERRED EMBODIMENTS OF THE INVENTION

Figure 1:
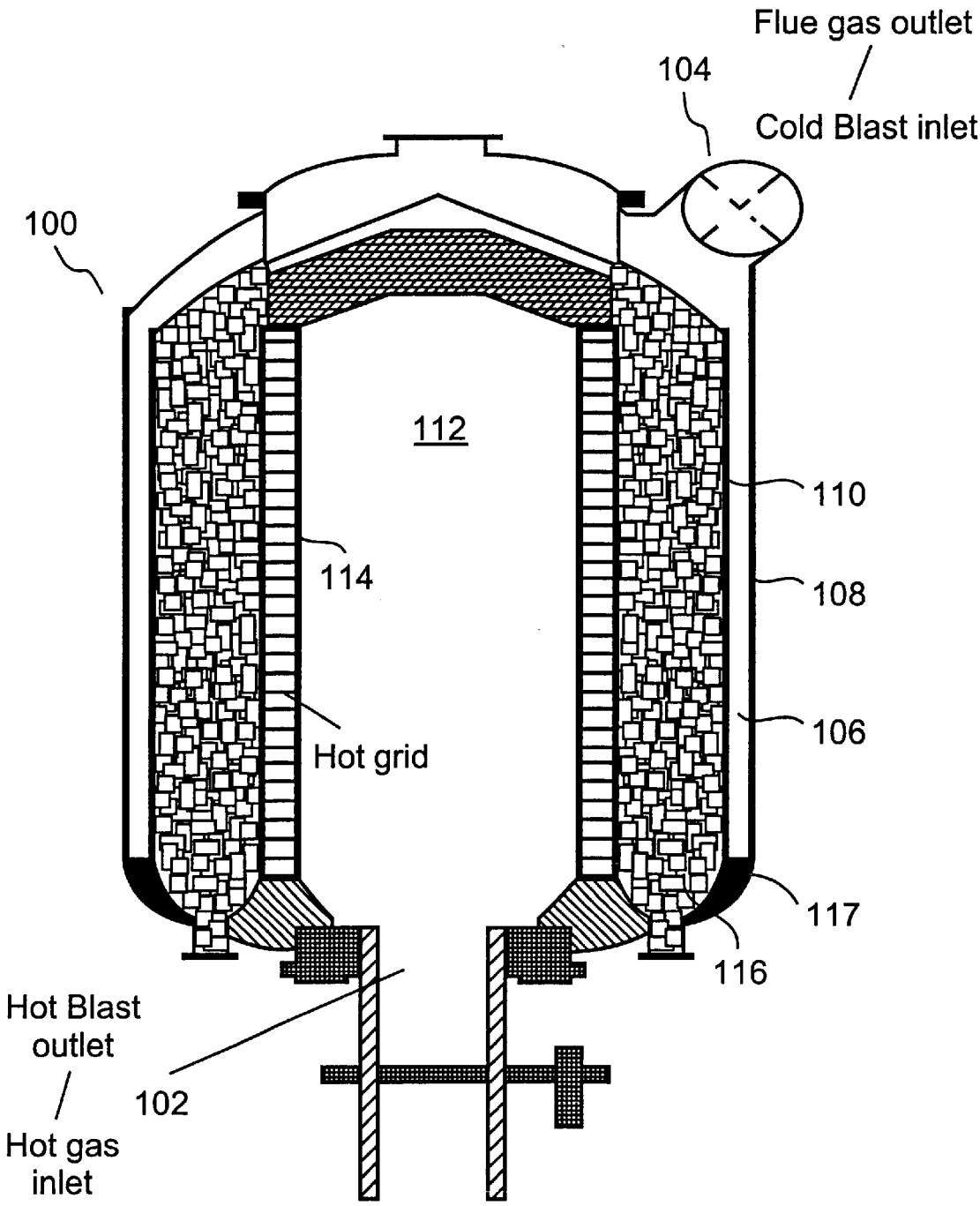
FIG. 1 illustrates in cross-section a regenerative heat exchanger which includes a hot grid formed from the bricks in accordance with the invention.

The invention will now be described with reference to FIG. 1, which illustrates a regenerative heat exchanger which advantageously employs the gas permeable refractory bricks and grid in accordance with the invention. Such a heat exchanger is described in U.S. application Ser. No. 09,525,115, filed on even date herewith, the entire contents of which are incorporated herein by reference.

The regenerative heat exchanger 100 allows a process to be carried out which involves recovering the heat from a hot gas stream during a gas phase, and transferring the heat to a flow of cold blast to be heated during a blast phase. The regenerative heat exchanger 100 includes a hot gas inlet 102, a flue gas outlet 104, a cold blast inlet 104 and a hot blast outlet 102. The flue gas outlet and the cold blast inlet 104 can be separate openings or share the same common orifice (as shown) in the shell of the apparatus. Similarly, the hot gas inlet and the hot blast outlet 102 can either be separate openings or share the same common orifice (as shown). In the case of a common orifice for either or both of the inlet/outlet pairs, a piping and valve system can be installed after the common opening(s) for the individual flows.

Each of these inlets and outlets can be provided with a suitable system of valves, actuators and other flow control devices to control the flow rate and pressure of the streams passing therethrough. Flow control of the various stream can be accomplished automatically by use of flow control devices and valves in combination with a suitable controller, for example a programmable logic controller (PLC).

The apparatus is preferably cylindrical in shape and is divided into at least three annular concentric spaces. First annular space (outer or cold collection chamber) 106, is located between outer shell 108 of the apparatus and an outer, annular cold grid 110. Second annular space (inner or hot collection chamber) 112 is the area of the apparatus within an inner, hot grid 114. The second annular space is generally located in the central region of the unit and is typically cylindrical in shape. Third annular space 116 defines a bed area between cold grid 110 and hot grid 114. The bed can be in a single space as shown or can be divided into a plurality of compartments by intermediary annular grids (not shown).

The bed contains a heat accumulation mass 117 which acts as the heat transfer means. This accumulation mass 117 is made up of a loose bulk material in particle form which is packed into the third annular space 116 of the bed. Depending on the requirement of the application, this bulk material can be of spherical, oval or even irregular shape. Advantageously, the particle size of the loose bulk material is selected to be less than about 20 mm. The material is selected to withstand high temperature variations over short periods of time. The small diameter of the bulk material is beneficial to its thermal shock resistance. Examples of a suitable heat accumulation mass include alumina pellets/balls, MgO pellets/balls, gravels or lava for lower duty.

FIGS. 2A–E illustrate various views of an exemplary brick 200 of a first embodiment of the invention for use in a hot grid of a regenerative heat exchanger. FIG. 2E is a partial sectional view of the brick 200, while FIGS. 2A and 2D are cross-sectional views taken along lines C—C and B—B, respectively, of FIG. 2E. FIGS. 2B and 2C are plan views of the brick 200.

The high operating temperatures (e.g., greater than 600 and even greater than 1400° C. in some applications) and repeated stress cycles to which the bricks in the hot grid are subjected in the heat exchanger place extreme demands on that structure. The bricks and grid can either be strong enough to withstand the stress build-up or can be designed in such a way that it is self-adjusting to the stress build-up.

This particular design relates to the former solution. The bricks and hot grid are thus of such a material and design to withstand temperature and stress variations to provide mechanical support to the particle bed by sustaining its geometry under such conditions. At the same time, the bricks and hot grid are of a design to be permeable to gases with a reasonable pressure drop and to be essentially unaffected by dust plugging. To achieve these goals, a macroscopically homogeneous structure which nevertheless has a good opening ratio for the gaseous streams is employed.

To withstand the temperature and stress variations required in the heat exchanger, the brick 200 is made of a refractory material, preferably refractory castable ceramics or refractory castable cement.

The geometry of the brick 200 allows for the formation of a cylindrical grid when the bricks are laid side-by-side with respect to sides 201, and when stacked to a desired height. Thus, the shape of the brick is preferably a sector of a circular ring of angle θ. Typically, the angle θof the ring sector is from about 10 to 30°, more preferably about 16°. The brick 200 is typically of a length l, measured from an inner face 210 to an outer face 206, of from about 10 to 80 cm, and of a height h of from about 15 to 50 cm.

The inner face 210 faces the inner hot collection chamber of the regenerator and the outer face 206 is in contact with the heat accumulation bed of the regenerator. The inner face 210 of the brick has at least one cavity 202, the cross-section of which can take various shapes. In the illustrated embodiment, the cross-section is generally rectangular. Preferably, the cross-section has a smaller dimension 204 greater than ten times the maximum diameter of the heat accumulation bed particles. Typically, the smaller dimension 204 of the cavity 202 is from about 4 to 15 cm. As shown in FIG. 2B, the exemplary brick has four cavities 202. If an individual brick has more than one cavity 202, each is preferably approximately equal in size, with the cavities being equally distributed over the inner face of the brick. These cavities typically extend for up to one half to two thirds the length l of the brick.

The outer portion of the brick, extending from the bottom of the cavities to the outer face 206 of the brick, is pierced by a plurality of longitudinal channels 208. Longitudinal channels 208 are fabricated in such a way that gases can freely circulate through the brick from the inner face 210 to the outer face 206 and vice versa. The bed particles are prevented from entering longitudinal channels 208 by proper sizing of the channels. In the exemplified embodiment, the longitudinal channels 208 are rectangular in cross-section, although other shapes are also envisioned. The smallest dimension of the longitudinal channels should not be larger than the diameter of the particles. In the case of the depicted rectangular channels, the larger dimension of the channels is preferably between five and ten times the smallest dimension. Typically, the smallest dimension is from about 0.3 to 1.5 cm, and the larger dimension is from about 1 to 8 cm.

The number of longitudinal channels 208 is selected to provide a suitable brick opening ratio while having sufficient material so as not to endanger the brick's mechanical properties.

Preferably, each individual brick is constructed from a single material and from a single piece of the material. Such a structure decreases the probability of a weak point in the brick by improving its homogeneity.

Figure 3A:
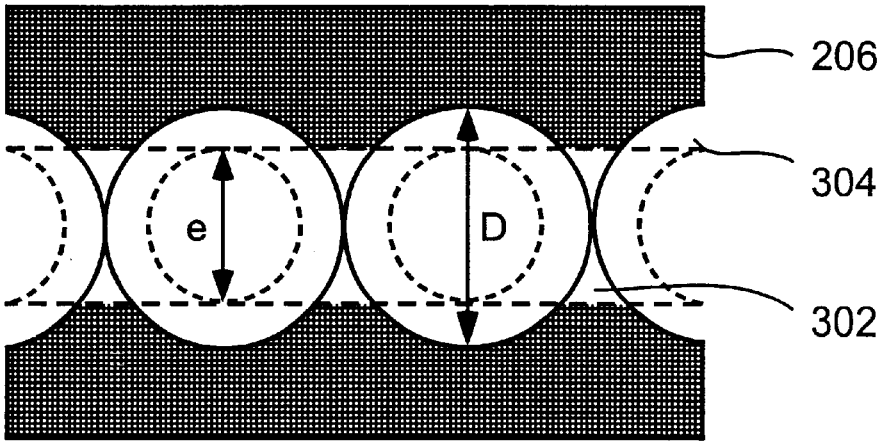
FIGS. 3A and 3B illustrate an outer face of the first exemplary brick design in accordance with the invention.
Figure 3B:
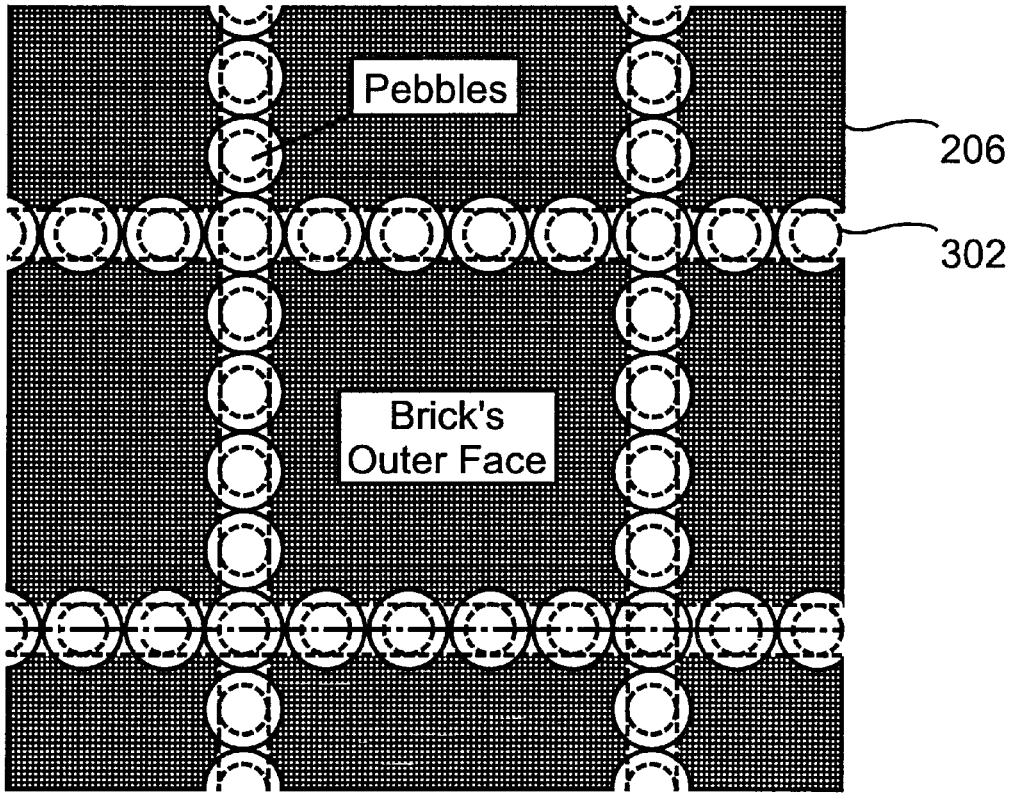

FIGS. 3A and 3B illustrate a preferred brick outer face design in accordance with a preferred aspect of the invention. To allow for a further decrease in pressure drop through the brick, a special channel profile can be employed in the outer face 206 of the brick where the longitudinal channels exit. It is particularly desirable to keep the opening section/brick section ratio within a reasonable range to guarantee proper mechanical properties of the hot grid. The free section seen by the gas flow up to at least the free section of the longitudinal channels can be increased by creating a network of shallow grooves 302 dug in outer face 206 of the brick. These grooves are typically a few millimeters deep, for example, from about 2 to 15 mm. Such a profile can effectively increase the free section seen by the gas. The brick preferably has a ratio of open area: closed area at the inner face of from 0.1:1 to 0.5:1, and a ratio of open area:closed area at the outer face of from 0.1:1 to 0.5:1.

In the case of spherical heat accumulation particles 304 in front of the groove 302, the free section seen by the gas is proportional to the opening section and can be understood from the following equation:

$$\frac{\text{free section}}{\text{opening section}} = 1 - \frac{\pi}{4} \cdot \frac{e}{D}$$

wherein:

e is the width of a groove, and

D is the diameter of the particles.

The sizes of the grooves 302 and other openings in the bricks 208 are selected to be large enough such that dust plugging during use of the heat exchanger is not a concern. The opening sections of the channels and grooves should also be large enough such that clogging by minor dust accumulation phenomenon does not occur. The brick design shown in FIG. 2 results in a mechanically resistant and homogeneous hot grid which has a low pressure drop and is dust-proof.

Figure 4A:
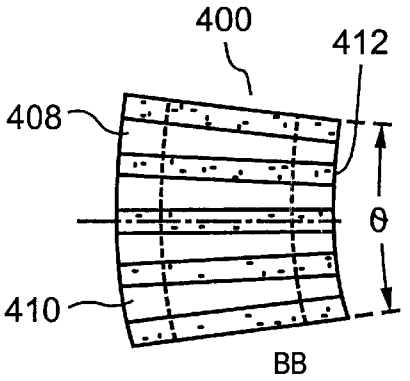
FIGS. 4A–E illustrate various views of a second exemplary brick design in accordance with the invention.
Figure 4B:
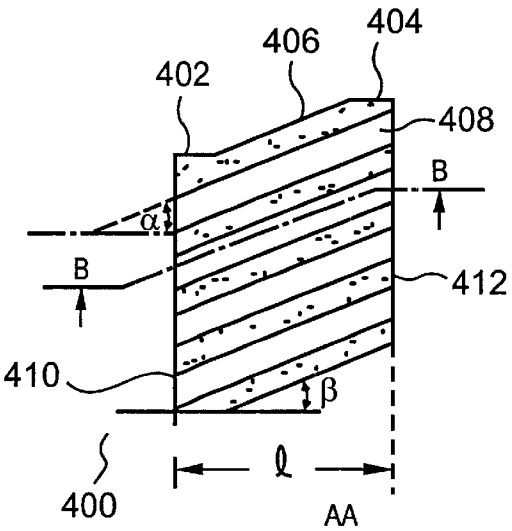
Figure 4C:
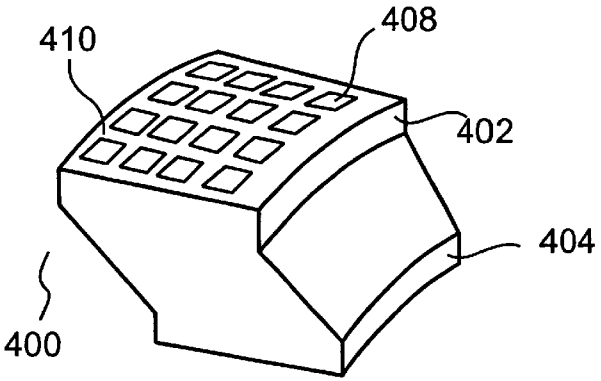
Figure 4D:
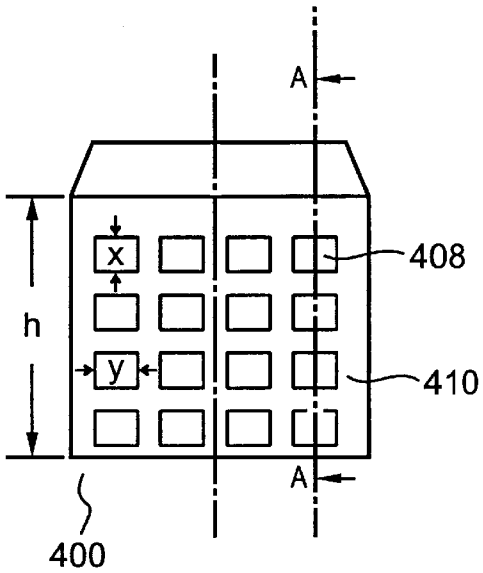
Figure 4E:
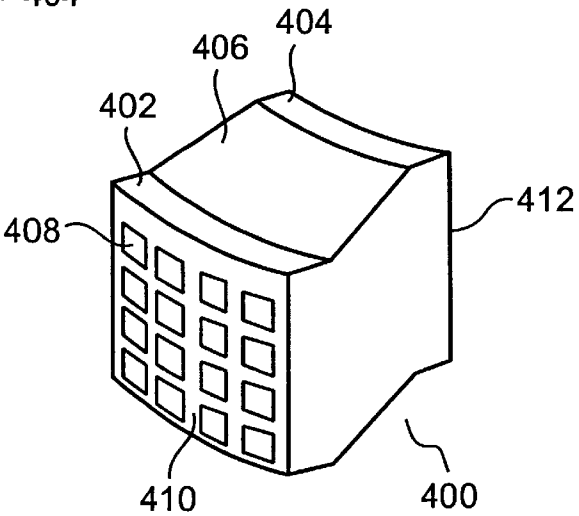

FIGS. 4A–E illustrate an exemplary brick 400 of a second embodiment of the invention. FIGS. 4C–E are various plan views of the brick 400, while FIG. 4B is a cross-sectional views taken along lines A—A of FIG. 4D. FIG. 4A is a cross-sectional views taken along lines B—B of FIG. 4B.

As with the first design, the brick and hot grid formed from the bricks should accommodate the possible stress build-up in the particle bed induced by the thermal cycling of the unit. This particular design, however, is self-adjusting to the stress build-up. In this embodiment of the invention, the brick 400 and hot grid formed therefrom are designed to allow the pebbles in the heat accumulation bed to expand freely in the radial direction without endangering the mechanical support function of the brick 400 or hot grid. The brick 400 and hot grid are designed in such a way that the particles making up the heat accumulation bed can freely move in the region of openings 408 formed therein.

This brick design is also advantageous for its ability to prevent the negative effects of dust accumulation in the hot grid. The hot grid formed from the bricks can be designed in such a way that particles of the heat accumulation bed are free to move in the region of the hot grid channel openings, with the blast stream kinetic energy creating limited particle movement in the hot grid region.

The overall design criteria for the brick 400 and hot grid in this embodiment are generally the same as used in the first embodiment, except for the provision of a free surface for the particles of the heat accumulation bed to move. Like the brick of the first embodiment, the brick 400 is made of a refractory a material, preferably refractory castable ceramics. The shape of the brick is preferably a sector of a circular ring of angle θ. Typically, the angle θ of the ring sector is from about 10 to 30°, more preferably about 16°. The brick 400 is typically of a length l of from about 15 to 80 cm, and of a height h of from about 20 to 60 cm.

At least one portion of the channel is not horizontal and makes an angle α with the horizontal, the slope increasing from the outer face 410 towards the inner face 412 of the brick 400. α is typically greater than 5°, preferably greater than 15°, and more preferably is approximately greater than or equal to the natural repose angle of the loose particles of the heat accumulation bed.

The brick 400 has at least one horizontal part 402, 404 and at least one non-horizontal, slanted part 406 with an angle β whose slope is positive in the direction towards the center of the heat exchanger unit, i.e., in the direction from outer face 410 to inner face 412. This allows for maintenance of a non-horizontal angle for the channels after stacking the bricks to form the grid. Angle β is preferably from about 5 to 50°. The channel angle α and the angle β of the slanted part of the brick are preferably the same. With βbeing 15°, the height h of the brick 400 would be about 39 cm (i.e., 35+15 tan (15°)). Slanted portion 406 is preferably disposed between two horizontal sections 402, 404. Each horizontal portion is preferably about 20% of the total length l of the brick.

At least one channel or cavity 408 penetrates through the brick from the inner face 412 to the outer face 410 of the brick 400. Typically, the brick 400 includes from about 1 to 50 channels 408, with the exemplified brick including 16 channels 408. The channels 408 are preferably distributed uniformly over the inner and outer faces 412, 410. Preferably, the ratio of open area:closed area at the inner face and the outer face is from 0.1:1 to 0.5:1.

The particles making up the heat accumulation bed when using this brick design preferably have a maximum diameter of 20 mm. The cross-section of the individual channels 408 is such that the loose bulk material particles can freely enter the channel without being stopped by any shape incompatibility. Preferably, the cross-sectional shape is rectangular. In the case of a rectangular channel cross-section, the channel has a smaller dimension x and a larger dimension y at the outer face 410 of the brick. The smaller dimension x of the channel 408 at the outer face 410 of the brick should be at least twice the maximum diameter of the loose bulk material particle, and is preferably from 5 to 10 times greater than the maximum diameter of the particles. The larger dimension y of the channel at the outer face is preferably from 2 to 10 times greater than the maximum diameter of the particles. Preferably, the smaller dimension x is from 2 to 20 cm, and the larger dimension y is from 2 to 25 cm. In the exemplary embodiment, the channel cross-section at the outer face 410 is 4.8×4.0 cm. Such a configuration allows the particles to expand freely, thereby releasing stress build-up during thermal cycling of the unit.

The gas velocity in the channels in the grid formed from the bricks should be lower then the fluidization speed limit of the particles in the heat accumulation bed. This can be accomplished by proper selection of the channel cross-section, which relates to the maximum diameter of the bed particles. The blast velocity V in the channels is given by the following equation:

$$V = \frac{Q_a}{3600} \cdot \frac{S_{HotGrid}}{n_{Channel/Brick} \cdot N_{Brick} \cdot S_{Channel}}$$

wherein:

$Q_a$ is the actual (A) gas flow rate during the blast phase in $Am^3/(hr \cdot m^2$ of hot grid)

$n_{Channel/Brick}$ is the number of channels per brick $N_{Brick}$ is the number of bricks in the hot grid $S_{Channel}$ is the cross-sectional area of an individual channel in $m^2$, and $S_{Hot\ Grid}$ is the surface area of the hot grid in $m^2$.

Figure 5:
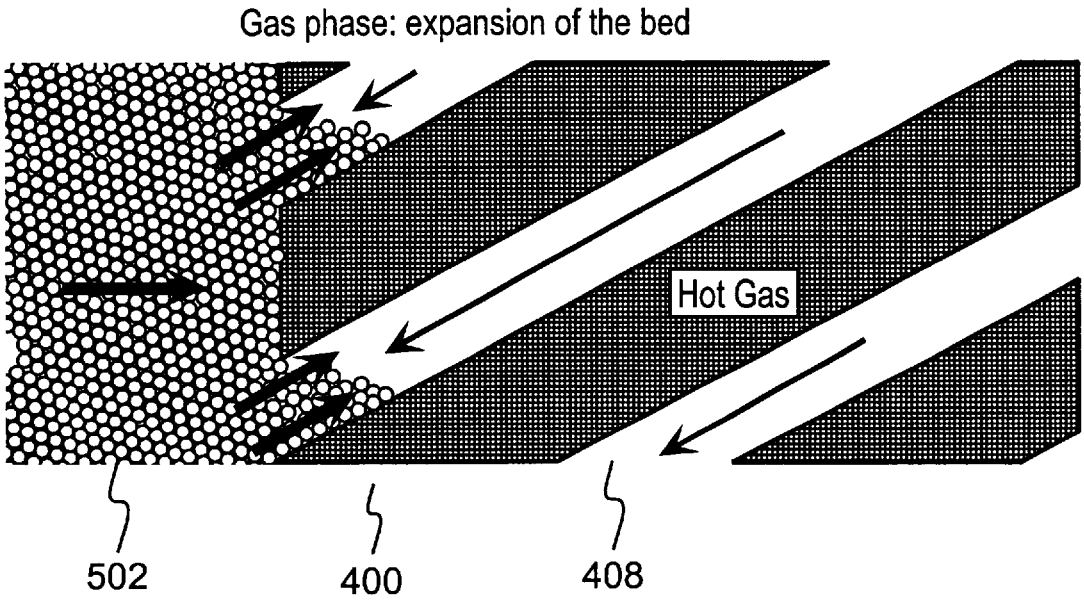
FIG. 5 illustrates in cross-section the second exemplary brick and particle bed in accordance with the invention during a gas phase.

FIG. 5 illustrates in cross-section a portion of a hot grid formed from a plurality of bricks 400 of the second embodiment and a heat accumulation bed 502 during the gas phase. During the gas phase, the average temperature of the particles in the heat accumulation bed increases. The particles of the bed 502 tend to expand due to the increase in temperature. As a result, they apply a radially compressive stress on the bricks 400 in the hot grid. Because the particles are free to move radially by their ability to enter the channels of the hot grid, the stress field is thereby released.

Figure 6:
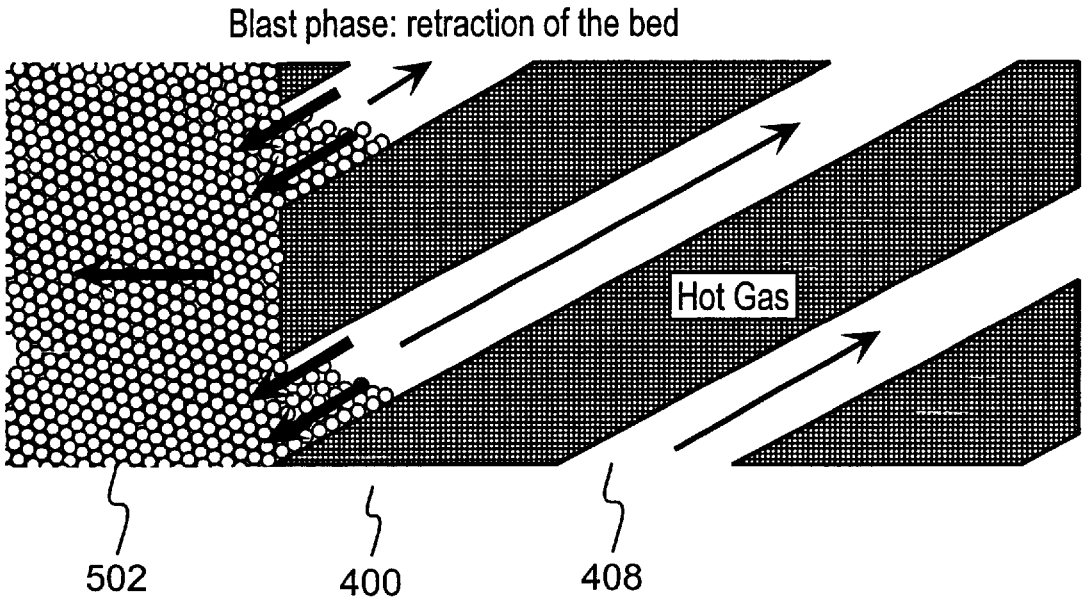
FIG. 6 illustrates in cross-section the second exemplary brick and particle bed in accordance with the invention during a blast phase.

FIG. 6 illustrates in cross-section a portion of a hot grid formed from a plurality of bricks 400 of the second embodiment and a heat accumulation bed 502 during the blast phase. During the blast phase, contraction of the particles in the heat accumulation bed 502 occurs and the particles in the channels 408 tend to move back towards the core of the bed due to the slope of the channels. This contraction, however, may not totally compensate for the previous expansion occurring during the gas phase. In such a case, the channels may fill up with particles from the bed over time. Some of the particles may then fall into the hot collection chamber where they can easily be collected.

In accordance with a preferred aspect of the invention, the cross-section of the individual channels at the outer face of the brick is such that the gas velocity V in the channel during the blast phase is lower than the pneumatic fluidization speed of the particles in the heat accumulation bed $V_{el}$ and greater than the Ledoux Velocity $V_L$;

$$V_L < V < V_{el}$$

wherein the Ledoux Velocity $V_L$ is defined according to the following equation:

$$V_L = 0.4 \cdot \sqrt{\frac{D \cdot \rho_b}{\rho_g}}$$

in which:

D is the diameter of the heat accumulation particles $\rho_b$ is the bed volumetric weight ($kg \cdot m^{-3}$), and $\rho_g$ is the gas volumetric weight ($kg \cdot m^{-3}$), The blast velocity V in the channels is given by the following equation:

$$V = \frac{Q_a}{3600} \cdot \frac{S_{HotGrid}}{n_{Channel/Brick} \cdot N_{Brick} \cdot S_{Channel}}$$

wherein:

$Q_a$ is the actual (A) gas flow rate during the blast phase in $Am^3/hr \cdot m^2$ of the hot grid $n_{Channel/Brick}$ is the number of channels per brick $N_{Brick}$ is the number of bricks in the hot grid $S_{Channel}$ is the cross-sectional area of an individual channel in $m^2$, and $S_{Hot\ Grid}$ is the surface area of the hot grid in $m^2$.

Preferably the blast velocity V is approximately equal to two times the Ledoux Velocity $V_L$. Due to the choice of the particular gas velocity range defined above for the blast flow during the blast phase, some particles of the heat accumulation loose bulk material can be drawn up into the channels by the blast stream. Since the blast velocity is well below the fluidization speed for this material, the blast keeps the particles of the bed agitated in the proximity of the hot grid, with relatively few particles being carried by the blast stream.

As the particles travel upwards through the channels, the blast velocity decreases. At the very inlet of the channels, the actual gas velocity seen by the particles is provided by the following formula:

$$V_{inlet} = \frac{Q_a}{3600 \cdot s'}$$

wherein s' is the free cross-sectional area of the opening in $m^2$. s' is typically about 55% of the entire cross-section because of the partial obstruction of the opening by the particles of the heat accumulation bed.

Since only one or two particles are typically present in the channel cross-section at higher points, the free opening is generally significantly larger and the actual velocity of the blast drops. This effect can optionally be enhanced by increasing the height of the individual channels towards the inner face of the brick 412. Whereas the channel width decreases slightly due to the design of the brick, the increase in height can keep the cross-sectional area constant and can even increase it, depending on the selected enlargement rate. Because of the decrease in velocity of the blast stream, the conditions drop below the point at which the particles can be transported in the stream. Consequently, the particles fall to the bottom of the channel and roll back downwards to the heat accumulation bed. Any particles traveling to the end of the channel fall to the bottom of the hot collection chamber due to the low gas velocity therein.

Agitation of the particles in the manner described effectively prevents gluing together of the particles by the dust load of the gases. As a result, the brick design effectively lessens the danger of an increasing pressure drop over time through dust plugging.

The invention is in no way limited to the exemplary brick designs described above, and other designs for the brick are also envisioned. For example, in the brick design of the second embodiment, the channels can have more than one non-horizontal portion having different angles for each such portion. Such a structure can better limit the total number of particles exiting the hot grid by making it more difficult for particles to travel through the entire length of the channels.

Preferably, the hot grid formed from the above-described bricks are cylindrical in shape, with the bricks being held together, for example, with refractory mortar or cement.

While the invention has been described in detail with reference to specific embodiments thereof, it will be apparent to one skilled in the art that various changes and modifications can be made, and equivalents employed, without departing from the scope of the appended claims.

What is claimed is:

1. A gas permeable brick of a refractory material suitable for use in a hot grid of a regenerative heat exchanger, comprising an inner face and an outer face on opposite sides of the brick, at least two cavities extending from the inner face partially into the brick, and a plurality of channels for each of the cavities extending from the outer face to the cavities and communicating fully with each of the cavities, the cavities and channels allowing a gas to pass through the brick.

2. The gas permeable brick according to claim 1, wherein the cavities are symmetrically distributed over the inner face of the brick.

3. The gas permeable brick according to claim 1, wherein the brick is constructed from a single material and from a single piece of the material.

4. A gas permeable brick of a refractory material suitable for use in a hot grid of a regenerative heat exchanger, comprising an inner face and an outer face on opposite sides of the brick, one or more cavities extending from the inner face partially into the brick, a plurality of channels for each of the cavities extending from the outer face to the cavities, the cavities and channels allowing a gas to pass through the brick; and wherein the brick has a shape which is a sector of a circle, the inner face facing the center of the circle and the outer face forming the periphery of the circle.

5. A gas permeable brick of a refractory material suitable for use in a hot grid of a regenerative heat exchanger, comprising an inner face and an outer face on opposite sides of the brick, one or more cavities extending from the inner face partially into the brick, a plurality of channels for each of the cavities extending from the outer face to the cavities, the cavities and channels allowing a gas to pass through the brick; and wherein the brick has a ratio of open area:closed area at the inner face of from 0.1:1 to 0.5:1, and a ratio of open area:closed area at the outer face of from 0.1:1 to 0.5:1.

6. A gas permeable brick of a refractory material suitable for use in a hot grid of a regenerative heat exchanger, comprising an inner face and an outer face on opposite sides of the brick, one or more cavities extending from the inner face partially into the brick, a plurality of channels for each of the cavities extending from the outer face to the cavities, the cavities and channels allowing a gas to pass through the brick; and wherein the cavities extend into the brick from the inner face about one half to two thirds the length of the brick, measured from the inner face to the outer face.

7. A gas permeable brick of a refractory material suitable for use in a hot grid of a regenerative heat exchanger, comprising an inner face and an outer face on opposite sides of the brick, one or more cavities extending from the inner face partially into the brick, a plurality of channels for each of the cavities extending from the outer face to the cavities, the cavities and channels allowing a gas to pass through the brick; and a plurality of grooves in the outer face overlapping the channels.

8. The gas permeable brick according to claim 7, wherein the grooves extend from 2 to 15 millimeters into the outer face.

9. A hot grid suitable use in a regenerative heat exchanger, comprising a plurality of the gas permeable bricks according to any of claims 1 to 8.

10. A gas permeable brick of a refractory material suitable for use in a hot grid of a regenerative heat exchanger, comprising an inner face and an outer face on opposite sides of the brick, a plurality of channels extending through the brick from the inner face to the outer face, said channels allowing a gas to pass through the brick; and wherein a top face and a bottom face of the brick each comprises at least one horizontal section and at least one non-horizontal section having a constant non-zero slope with respect to the horizontal section in a direction from the outer face to the inner face.

11. The gas permeable brick according to claim 10, wherein the brick has a shape which is a sector of a circle, the inner face facing the center of the circle and the outer face forming the periphery of the circle.

12. The gas permeable brick according to claim 10, wherein the brick has a ratio of open area:closed area at the inner face and the outer face of from 0.1:1 to 0.5:1.

13. The gas permeable brick according to claim 10, wherein the channels have a cross-sectional area of from about 4 to 500 $cm^2$.

14. The gas permeable brick according to claim 13, wherein the channel cross-sectional area is substantially constant along the length thereof.

15. The gas permeable brick according to claim 10, wherein the slope of the non-horizontal section is greater than 15° from horizontal.

16. The gas permeable brick according to claim 10, wherein the brick is constructed from a single material and from a single piece of the material.

17. A hot grid suitable use in a regenerative heat exchanger, comprising a plurality of the bricks according to any of claims 10–16.

18. The hot grid according to claim 17, wherein the channels have a slope of greater than 15° from horizontal, the channels sloping upwardly from the outer face to the inner face.

* * * * *